US012104614B1

(12) United States Patent
Chan

(10) Patent No.: US 12,104,614 B1
(45) Date of Patent: Oct. 1, 2024

(54) QUICK INSTALLATION CEILING FAN BLADES

(71) Applicant: PUC Perfect Union Co., Ltd., New Taipei (TW)

(72) Inventor: Ching Chan, New Taipei (TW)

(73) Assignee: PUC PERFECT UNION CO., LTD., New Taipei (TW)

( * ) Notice: Subject to any disclaimer, the term of this patent is extended or adjusted under 35 U.S.C. 154(b) by 0 days.

(21) Appl. No.: 18/604,004

(22) Filed: Mar. 13, 2024

(51) Int. Cl.
*F04D 29/34* (2006.01)
*F04D 19/00* (2006.01)
*F04D 29/32* (2006.01)

(52) U.S. Cl.
CPC ..... *F04D 29/34* (2013.01); *F04D 19/002* (2013.01); *F04D 29/329* (2013.01)

(58) Field of Classification Search
CPC ..... F04D 29/34; F04D 29/329; F04D 25/088; F04D 19/002
See application file for complete search history.

(56) References Cited

U.S. PATENT DOCUMENTS 6,821,091 B2 * 11/2004 Lee ..... F04D 29/34 416/207
7,762,782 B2 * 7/2010 Wang ..... F04D 29/34 416/214 R
7,771,172 B2 * 8/2010 Wang ..... F04D 29/34 416/207
8,197,216 B2 * 6/2012 Wang ..... F04D 29/646 416/210 R
2009/0035144 A1 * 2/2009 Wang ..... F04D 25/088 416/220 R

* cited by examiner

*Primary Examiner* — Michael L Sehn
(74) *Attorney, Agent, or Firm* — Demian K. Jackson; Jackson IPG PLLC

(57) ABSTRACT

The invention employs blades featuring multiple holes. The metal decoration for coupling conceals perforated sections, which ease the mounting and alignment for screws installation. The blade holder incorporates two or more slots for screws to slide through the decoration cover, securing the blade assembly onto the fan motor for assembly and operation. The decoration cover has a minimum of two holes for alignment screw installation and one hole for preassembling and fastening it onto the blade. Alignment screws serve a dual purpose by sliding into the blade holder's slots and installing the blade assembly. This not only aligns the blade holder but also temporarily holds the assembly, freeing the installer's hands for subsequent installation steps. This simplifies the process, minimizes installer fatigue and allowing the use of both hands to handle screws, making it a time-efficient and straightforward task. The installation difficulty then reduces from 9 to 1.

1 Claim, 3 Drawing Sheets

QUICK INSTALLATION CEILING FAN BLADES

FIELD OF THE INVENTION

The invention relates to fan blades and more particularly to a device for quickly installing blades of a fan (e.g., ceiling fan).

BACKGROUND OF THE INVENTION

High volume low speed large diameter industrial ceiling fans are shipped in carton or wooden box with fan motor and components that will be assembled by the electrician/installer at field. The metal fan blades, characterized by their substantial length and weight, require a robust structure capable of withstanding the considerable torque generated during operation. Typically, multiple bolts, nuts, or screws are employed as fasteners to securely attach the metal fan blades and covers onto the blade holder (fan arm), which is mounted on the fan motor. This approach ensures a sturdy and reliable mounting solution for these fans.

Installing a conventional large industrial ceiling fan involves managing not less than three sets of screws and nuts, along with metal blades and/or decorative covers on each blade. This process requires handling half a dozen small and loose parts, aligning the long blades with holes on the blade holder, and inserting screws and nuts to attach the blades to the fan motor. The weight of the long blades poses challenges for alignment, making it difficult for the installer who must also manage an electric screwdriver with one hand while handling the blades with the other. This assembly, taking place at heights of 10 to 15 feet above the ground, requires careful and patient work, balancing to prevent falls. Installers may face fatigue and the risk of parts falling during assembly, necessitating climbing up and down to retrieve them. The process often takes over an hour to install 6 to 9 blades for a single ceiling fan.

U.S. Pat. No. 8,845,293 B1 discloses a quick ceiling fan blade installation involving a blade with three slots running linearly from the mounting end. Three pre-attached fasteners on the blade arm include a springably bendable one with an inwardly extending clip edge, another forming an upright post, and a third with an outwardly extending lip edge. Alternatively, there's an embodiment with four slots and four pre-attached fasteners. The method includes angling the blade towards the mounting end so that the lip edge catches the third slot. Then, laying the blade down lets the other two slot openings pass over remaining fasteners, moving the mounting end toward the motor mounting end, causing the bendable fastener to snap back and lock the blade onto the blade arm.

U.S. Pat. No. 8,845,293 B1 further suggests that its clip-on method with a springily bendable, inwardly extending clip edge is not suitable for large diameter industrial ceiling fans. The concern lies in the long and weighty metal blades operating under high torque, rendering the clip-on and spring-back structure incapable of securely locking the blade in position. There are worries about deformation and potential failure, as the torque applied to the long blade can distort the clip-on structure, causing the blade to jump out from the lock slot and potentially breaking the spring-able mechanism.

A conventional device for fastening a blade 1 of a fan (e.g., ceiling fan) is shown in FIG. 1. A plurality of screws 3 are driven through a plurality of holes 42 of a extension 41 of a radial support plate 4 and a plurality of holes 11 of the blade 1 into a plurality of bossed threaded holes 21 of a fastening plate 2. As such, the blade 1, the fastening plate 2 and the radial support plate 4 are fastened together.

However, the conventional device is disadvantageous because a precise fastening of the bulky blade 1 is difficult.

Thus, the need for improvement still exists.

SUMMARY OF THE INVENTION

The inventor, considering the length of the fan blade and the high-torque operation, proposes a redesign for quick installation. The new concept avoids using a springily clip-on structure and instead opts for screws to securely install and fasten the blade, ensuring a safe and reliable blade attachment. The approach involves moving the slot from the blade to the blade holder, employing metal-to-metal assembly, and securing it with screws to guarantee the strength and reliability of both the fan blade and blade holder. The alignment shifts from a springily clip-on structure to screws, creating a steel-to-steel alignment system that offers accuracy and strength during temporary assembly and allows hands-free operation after aligning the blade assembly. This innovative method aims to address both structural strength and assembly accuracy, presenting a safe and reliable quick installation deserving of a patent award.

It is therefore one object of the invention to provide a device for fastening a blade including a fourth threaded hole, a plurality of positioning holes, and a plurality of fifth threaded holes, comprising a fastening plate including a first threaded hole, a plurality of positioning pins and a plurality of second threaded holes; and a radial support plate including a plurality of extensions having an elongated through hole, a plurality of teardrop-shaped through holes having a narrow part, and a plurality of third threaded holes; wherein a first screw is configured to drive through the fourth threaded hole into the first threaded hole to assemble the blade and the fastening plate with the positioning pins passing through the positioning holes; wherein the positioning pins further pass through the teardrop-shaped through holes with the head of the first screw disposed in the elongated through hole; wherein the blade and the fastening plate together are configured to push toward a center of the radial support plate to secure the positioning pins to the narrow parts of the teardrop-shaped through holes; and wherein a plurality of second screws are configured to drive through the third threaded holes and the fourth threaded holes into the second threaded holes, thereby fastening the blade, the fastening plate, and the extension of the radial support plate together.

The above and other objects, features and advantages of the invention will become apparent from the following detailed description taken with the accompanying drawings

DETAILED DESCRIPTION OF THE INVENTION

Figure 1:
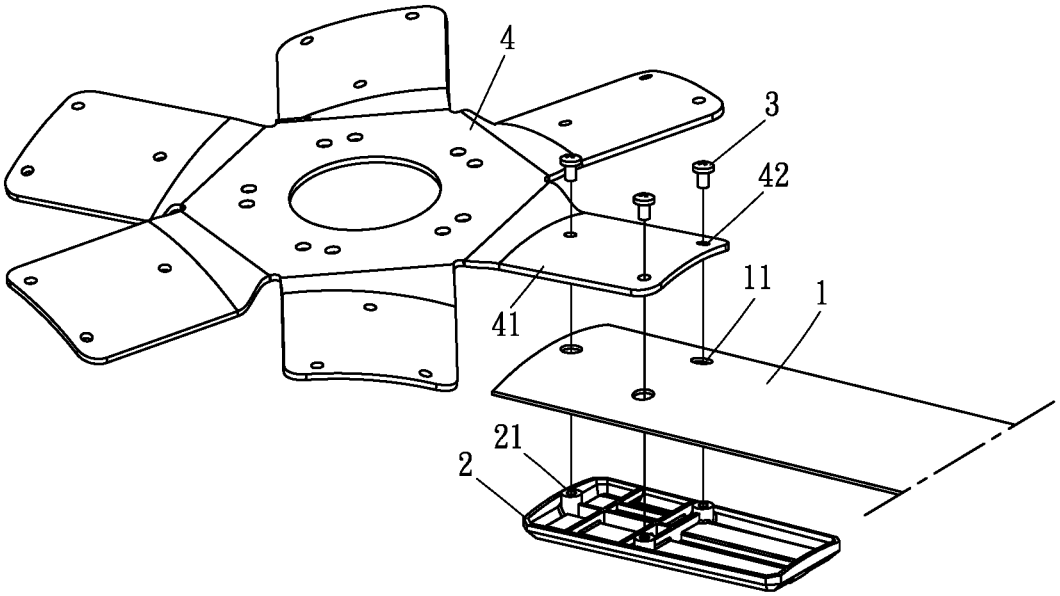
Fig. 1 Prior Art
FIG. 1 is an exploded view of a conventional device for fastening fan blade.
Figure 2:
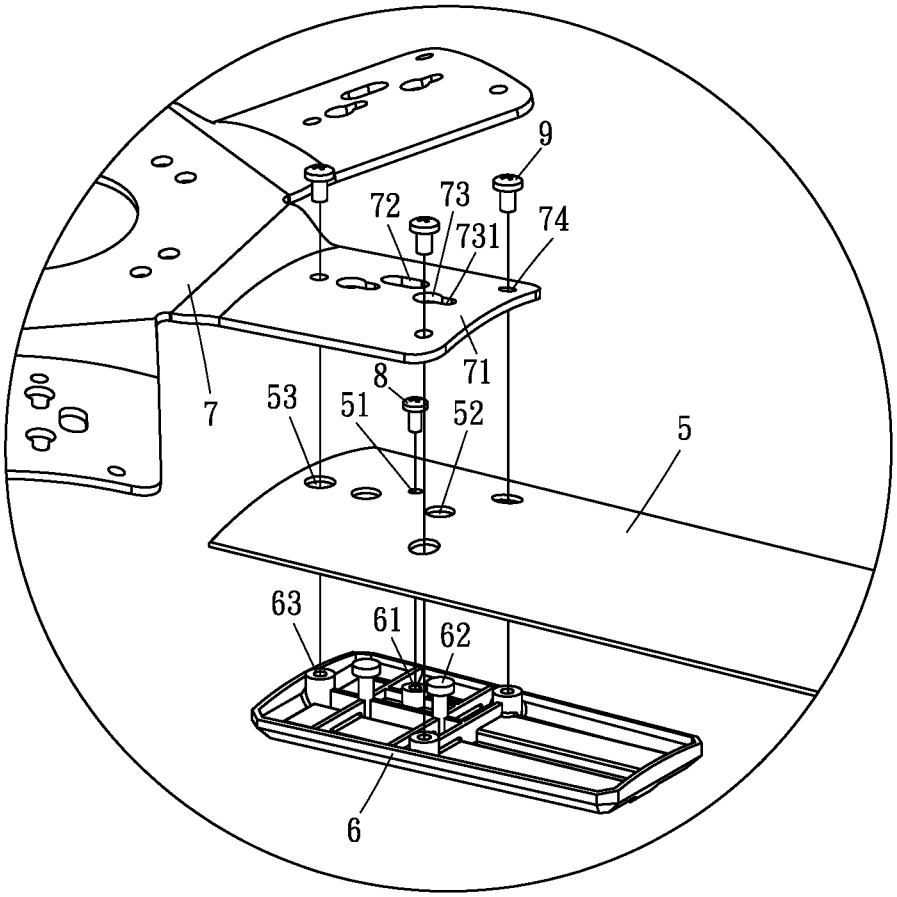
FIG. 2 is an exploded view of a fastening device according to the invention.

Referring to FIGS. 2 to 6, a fastening device of the invention is shown and comprises a fastening plate 6 including a first threaded hole 61, two positioning pins 62 and a plurality of second threaded holes 63; and a radial support plate 7 including a plurality of extensions 71 having an elongated through hole 72, two teardrop-shaped through holes 73 having a narrow part 731, and a plurality of third threaded holes 74. A blade 5 includes a fourth threaded hole 51, a plurality of positioning holes 52, and a plurality of fifth threaded holes 53.

Figure 3:
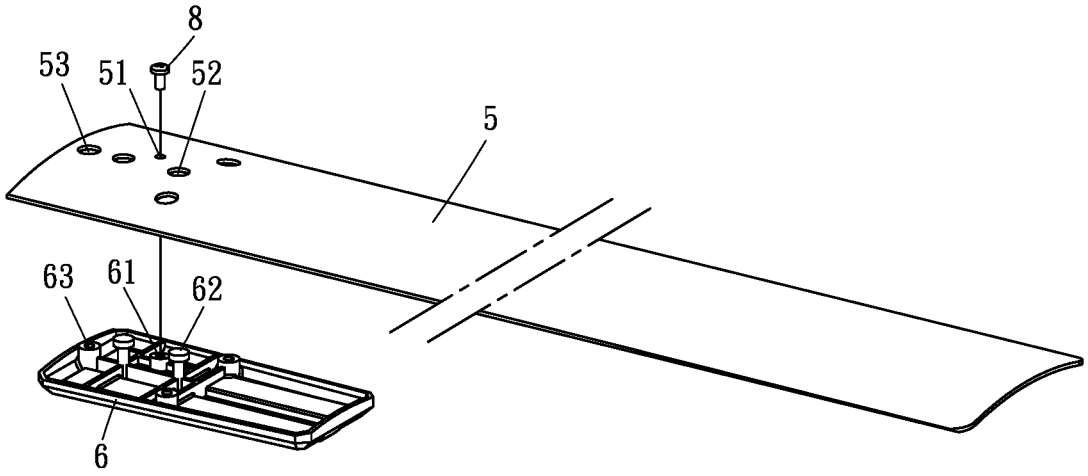
FIG. 3 is an exploded view of the blade and the fastening plate in FIG. 2.
Figure 4:
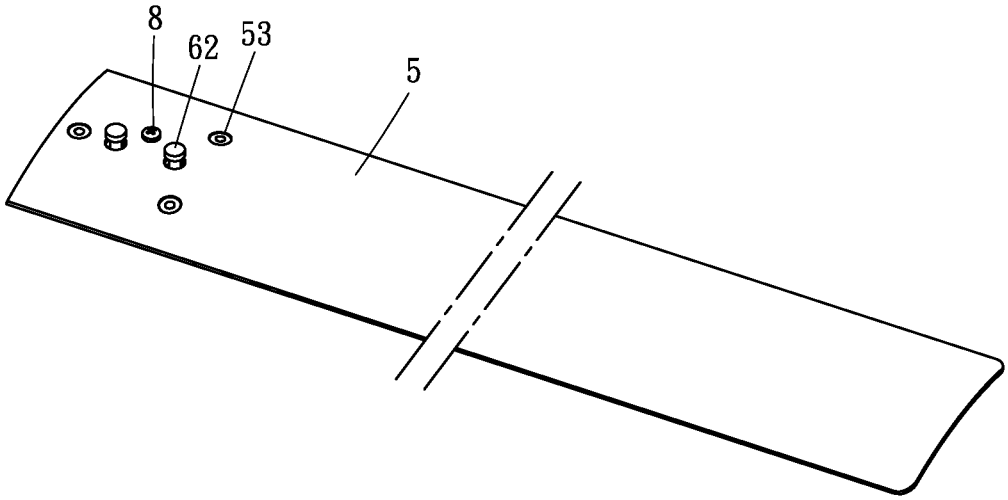
FIG. 4 is a perspective view of the blade and the fastening plate in an assembled state in FIG. 3.

As shown in FIGS. 3 and 4 specifically, an initial assembly of the invention is discussed below. A screw 8 is driven through the fourth threaded hole 51 into the first threaded hole 61 so that the blade 5 and the fastening plate 6 are assembled. Further, the positioning pins 62 pass through the positioning holes 52.

Figure 5:
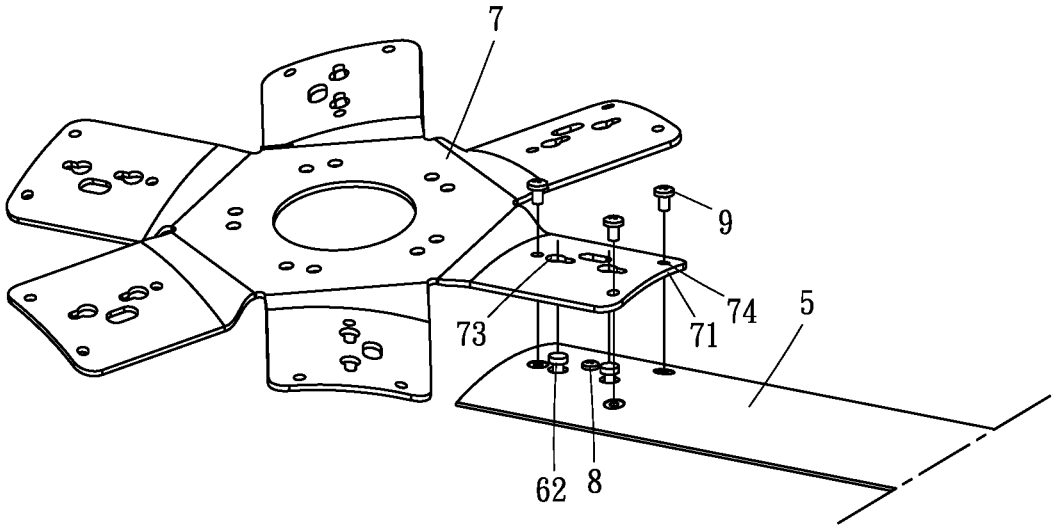
FIG. 5 depicts the blade and the fastening plate in FIG. 4 to be secured to the extension of the radial support plate.
Figure 6:
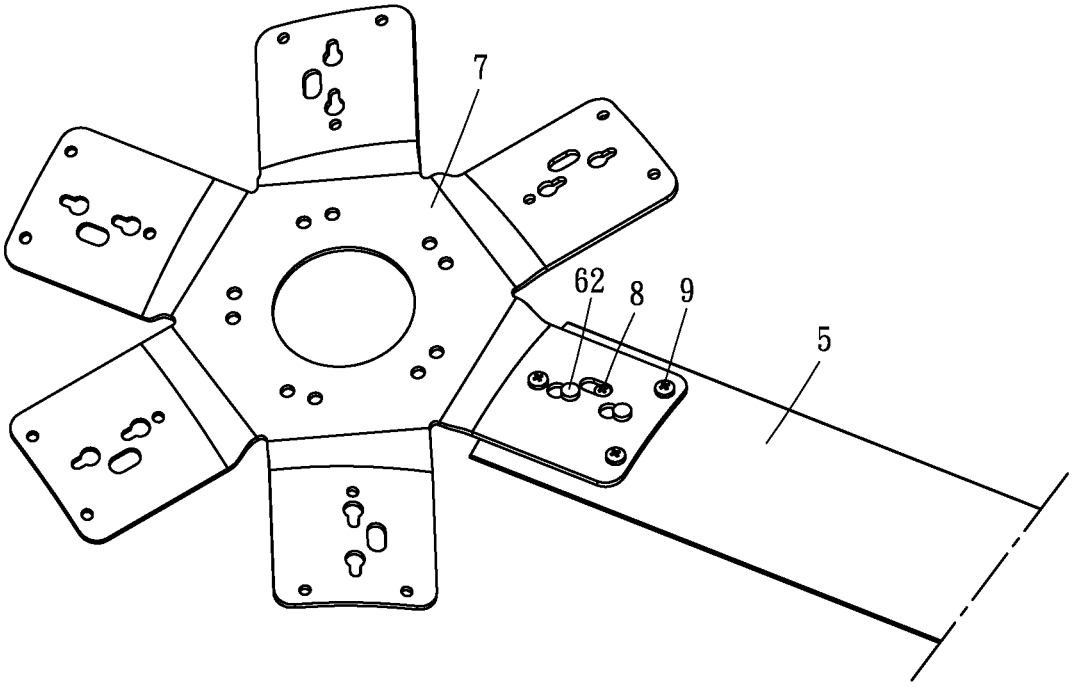
FIG. 6 is a perspective view of the blade, the fastening plate, and the extension of the radial support plate in an assembled state in FIG. 5.

As shown in FIGS. 5 and 6 specifically, a final assembly of the invention is discussed below. The positioning pins 62 further pass through the teardrop-shaped through holes 73. The head of the screw 8 is disposed in the elongated through hole 72. Further, an individual may push the blade 5 and the fastening plate 6 together toward a center of the radial support plate 7 to secure the positioning pins 62 to the narrow parts 731 of the teardrop-shaped through holes 73. Thereafter, the individual may drive a plurality of screws 9 through the third threaded holes 74 and the fourth threaded holes 53 into the second threaded holes 63. As a result, the blade 5, the fastening plate 6, and the extension 71 of the radial support plate 7 are assembled.

While the invention has been described in terms of embodiments, those skilled in the art will recognize that the invention can be practiced with modifications within the spirit and scope of the appended claim.

What is claimed is:

1. A device for fastening a blade including a fourth threaded hole, a plurality of positioning holes, and a plurality of fifth threaded holes, comprising:

a fastening plate including a first threaded hole, a plurality of positioning pins, and a plurality of second threaded holes; and a radial support plate including a plurality of extensions having an elongated through hole, a plurality of teardrop-shaped through holes having a narrow part, and a plurality of third threaded holes;

wherein a first screw is configured to drive through the fourth threaded hole into the first threaded hole to assemble the blade and the fastening plate with the positioning pins passing through the positioning holes;

wherein the positioning pins further pass through the teardrop-shaped through holes with the head of the first screw disposed in the elongated through hole;

wherein the blade and the fastening plate together are configured to push toward a center of the radial support plate to secure the positioning pins to the narrow parts of the teardrop-shaped through holes; and wherein a plurality of second screws are configured to drive through the third threaded holes and the fourth threaded holes into the second threaded holes, thereby fastening the blade, the fastening plate, and the extension together.

* * * * *